US005408759A

United States Patent [19]

Bass

[11] Patent Number: 5,408,759

[45] Date of Patent: Apr. 25, 1995

[54] WALL DRYING DEVICE

[76] Inventor: Lenny Bass, P.O. Box 1681, Lake City, Fla. 32056

[21] Appl. No.: 161,329

[22] Filed: Dec. 2, 1993

[51] Int. Cl.[6] ..... F26B 25/00

[52] U.S. Cl. ..... 34/104; 34/439; 34/618

[58] Field of Search ..... 34/21, 104, 243 R, 151, 34/437, 439, 237, 618; 392/371, 379

[56] References Cited

U.S. PATENT DOCUMENTS

| | | | |
|---|---|---|---|
| 2,122,964 | 7/1938 | Sweetland | 34/243 R |
| 3,007,256 | 11/1961 | Rouy | 34/237 |
| 3,487,557 | 1/1970 | Linstead | 34/151 |
| 5,155,924 | 10/1992 | Smith | 34/243 R |
| 5,214,860 | 6/1993 | Landes | 34/243 R |

FOREIGN PATENT DOCUMENTS

| | | | |
|---|---|---|---|
| 564420 | 12/1923 | France | 34/243 R |
| 546486 | 2/1932 | Germany | 34/243 R |

*Primary Examiner*—Denise L. Gromada
*Attorney, Agent, or Firm*—Thomas C. Saitta

[57] ABSTRACT

A wall drying device having an elongated main chamber composed of a flexible, air impermeable material, a number of flexible air conduits tapering down to nozzle ends for insertion into air access holes drilled into a wall to be dried, and a blower port for receiving an air blower device. The main chamber has sealable ends whereby two or more main chambers can be joined together to form an enlarged drying device.

10 Claims, 2 Drawing Sheets

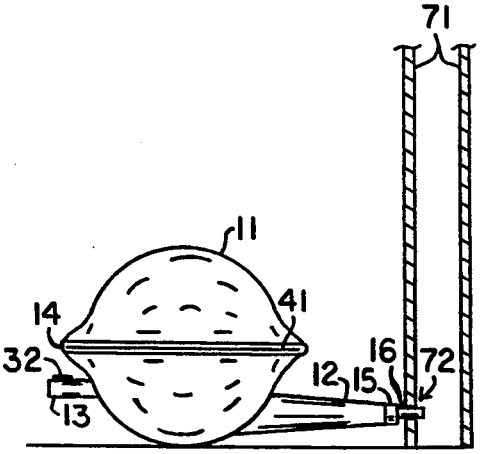
FIG. 3
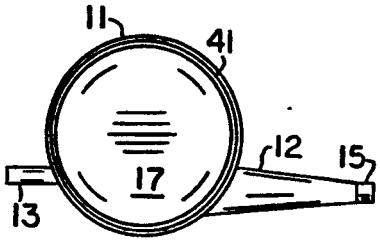
FIG. 4
FIG. 5
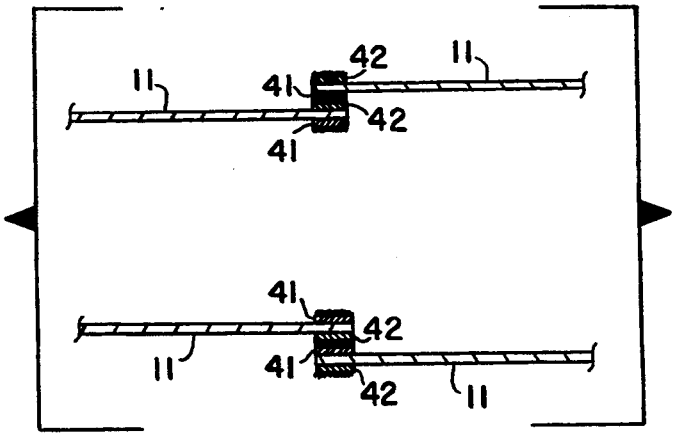
FIG. 6
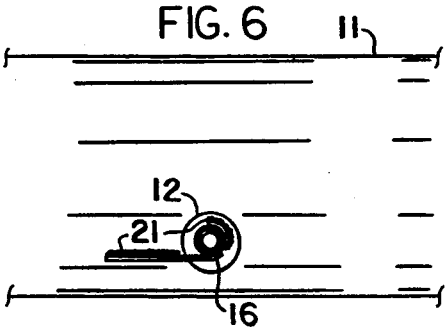
FIG. 7
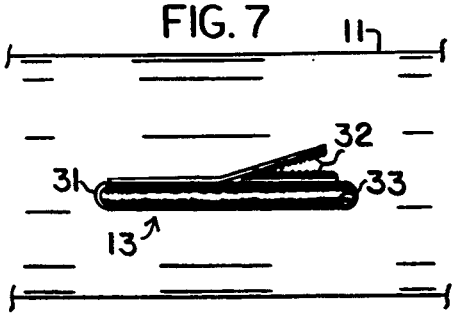

WALL DRYING DEVICE

BACKGROUND OF THE INVENTION

This invention relates generally to the field of devices used to dry water damaged walls in buildings and the like. More particularly, the invention relates to devices used with the technique of forcing air into the internal spaces of walls between the studs to dry water damaged walls. Even more particularly, the invention relates to the technique and a device comprising a flexible bag with a number of individual air conduits adapted to be inserted into individual drying holes in the wall, where the bag is connected to a blower device, and further where the bag has sealable ends whereby plural bags can be joined together to operate off a single blower.

In situations where there is a roof failure or leakage, or water pipe failure or leakage in a building, the interior wall components, such as sheetrock panels, often become soaked by water. Removal and replacement of the wall components is a costly solution, but is the solution often chosen because practical and efficient mechanisms for sufficiently drying the wall components and interior spaces do not exist. A typical method for drying is to position a high volume air blower in the room to dry the walls by circulating a large amount of air to encourage evaporation. This technique is lacking in that drying time is much too long—typically requiring weeks to finish—so that business or home owners are more likely to choose the option of replacing the walls in several days rather than suffering the inconvenience of waiting for weeks.

To improve on this, it is known to drill small holes through the walls between each of the vertical studs and then direct air towards them, thus allowing air to flow into the interior spaces of the wall. This lowers drying time somewhat, but is still slow. To improve on this, it is also known to utilize a long, rigid box, typically constructed of plywood, which has one open side. The blower is connected to the box and the open side of the box is pushed against the wall where the holes have been cut into the wallboard panels. This technique maximizes air flow into the holes, but the box is cumbersome and can only be utilized where the wall is straight with no interfering objects (cabinets, toilets, sinks, etc.).

It is an object of this invention to provide a device for drying water damaged walls which works in conjunction with holes drilled into the wall to maximize air circulation within the internal spaces of the wall.

It is a further object to provide such a device that is adaptable for use with any wall configuration, including corners and curves, and in situations where obstructions are attached to or are adjacent to the walls needing to be dried.

It is a further object to provide such a device which can be joined to one or more other similar devices to create a drying device of extended length, yet requiring only one blower device to provide the necessary air flow.

It is a further object to provide such a device which is adaptable for connection with different blower devices.

It is a further object to provide such a device which allows for introduction of deodorants or disinfectants into the interior spaces of the wall.

SUMMARY OF THE INVENTION

The invention is a device for drying water damaged interior walls utilized in conjunction with air blower devices and a number of access holes cut into the wall to be dried, each access hole being located between each adjacent pair of vertical studs or supports. The device generally comprises a flexible, elongated, tubular main chamber, sealable at each end, a number of flexible air conduits extending from the main chamber, each having an open nozzle end adapted to mate with an access hole in the wall, and a sealable blower port adapted to encircle the blower nozzle of an air blower device.

The device is mainly constructed of an air impermeable fabric or sheet material, such that the main chamber and air ducts are collapsible for transport and storage, but expand when air is forced into the device. The blower port is adapted to snugly fit over the blower mouth, and can also be sealed completely, preferably with a hook and pile type fastener, if no air blower is inserted. The flexible air conduits are preferably conical in configuration, with their cross-sectional diameter decreasing from the point of attachment to the main chamber out to the nozzle end. Each nozzle end incorporates, or is connectable to, a rigid tubular insertion member, such as a piece of PVC pipe, which is inserted into an individual wall access hole. The ends of the tubular main chamber are releasably sealable, preferably with a hook and pile type fastener, whereby either end may be unsealed and connected to a like unsealed end of a second main chamber to form an enlarged main chamber operating off a single air blower device.

Because of the flexibility of the main chamber and individual air conduits, and because the individual air conduits extend from the main chamber, the device can be used in corners, with curved or angled wall configurations, and where obstructions protrude from the wall or are set in place adjacent the wall. The sealable ends of the main chamber allow a number of units to be joined end-to-end to operate off a single air blower, the unused blower ports of each main chamber, as well as any unused air conduits, being sealed to prevent air loss. Because the air can only exit through the end nozzles of the air conduits, air flow into the interior of the wall space is maximized for optimum drying efficiency. Deodorants or disinfectants can be introduced into the main chamber for delivery into the wall space by inserting the discharge nozzle of a deodorant or disinfectant introduction device through a portion of a sealed end of the main chamber.

BRIEF DESCRIPTION OF THE DRAWINGS

FIG. 3 is an end view of the preferred embodiment of the invention, showing it as positioned in use to dry a wall.

FIG. 4 is an end view of an alternative embodiment of the invention.

FIG. 5 is a cross-sectional view taken along the longitudinal axis of two main chambers joined together.

FIG. 6 is an end view of an air conduit.

FIG. 7 is an end view of an open blower port.

DETAILED DESCRIPTION OF THE INVENTION

Figure 1:
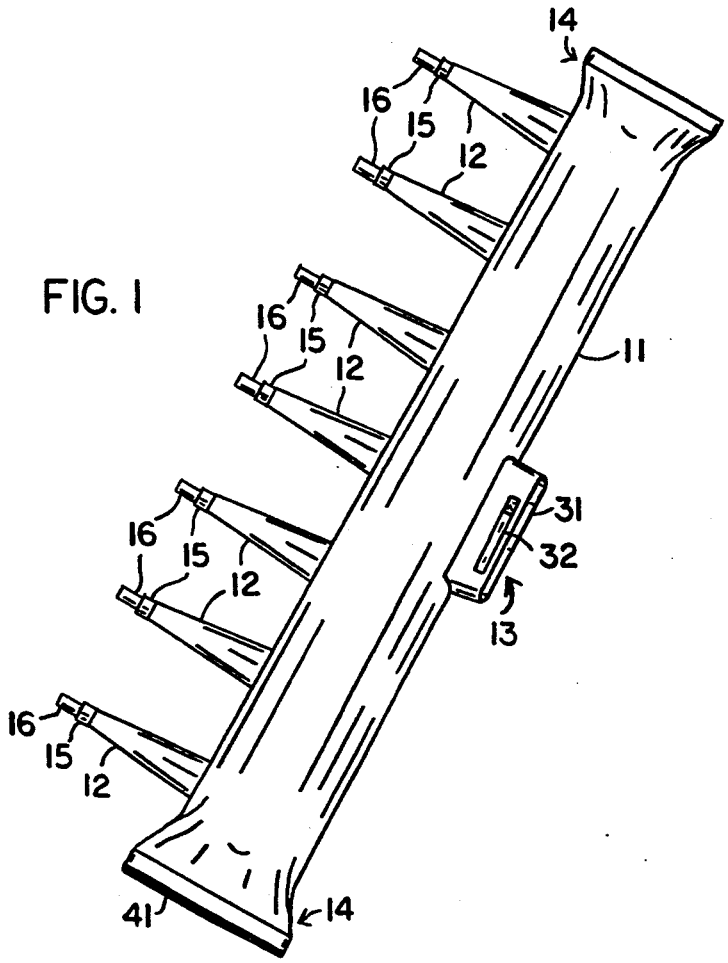
FIG. 1 is perspective view of the invention.

Referring now to the drawings, the invention will be described in detail with the preferred embodiment and best mode set forth. In general, with reference to FIGS. 1 and 2, the invention comprises a main chamber 11, a number of air conduits 12 extending from the main chamber 11, and a blower port 13. Main chamber 11 is a flexible, collapsible, elongated hollow member, preferably tubular in shape. Main chamber 11 is constructed of an air-impermeable material, such as a fabric of canvas material or the like, or a flexible synthetic material. The ends 14 of main chamber 11 may be permanently sealed, or preferably each end 14 has end fastener means 41 which allow each end 14 to be completely sealed to block air flow as well as opened to allow for insertion of deodorant or disinfectant discharge devices, or to allow for two main chambers 11 to be joined together to form an enlarged device. The blower port 13 extends from the main chamber 11 on the opposite side from the air conduits 12, and is preferably located at the longitudinal midpoint of the main chamber 11.

Figure 2:
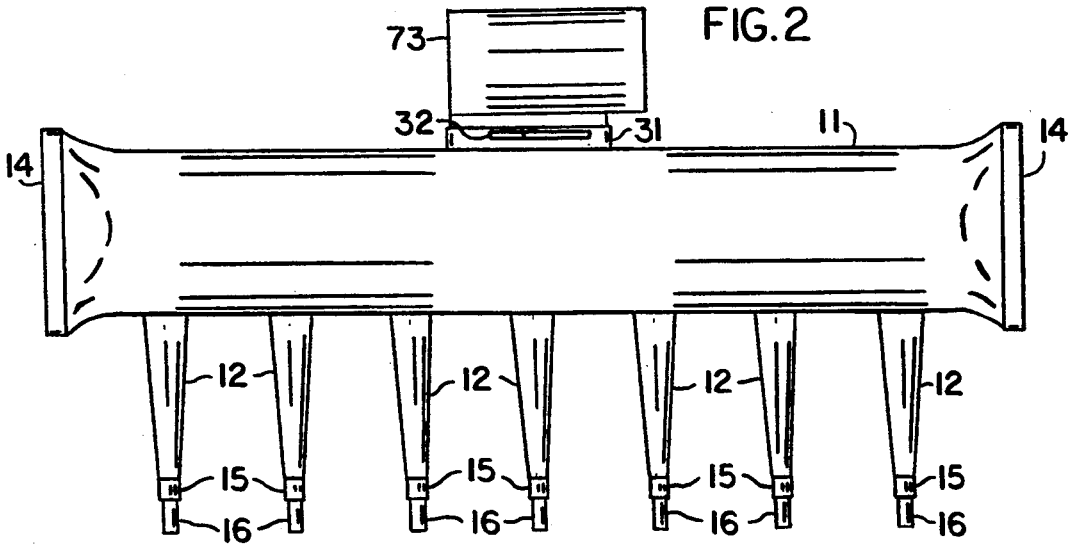
FIG. 2 is a top view of the invention shown connected to an air blower.

Blower port 13 is an opening into the main chamber 11 which is adapted to be attachable to the outlet of an air blower device 73, as shown in FIG. 2. With reference to FIG. 7, blower port 13 preferably comprises an annular flange or lip 31 to encircle the outlet of the air blower device 73, with blower port fastener means 32 to secure the lip 31 to the air blower 73. The lip 31 is preferably composed of the same material as the main chamber 11. Blower port sealer means 33 allow the blower port 13 to be closed off and sealed if no air blower 73 is inserted. The sealer means 33 may be any suitable fastening device, but is preferably comprised of a hook and pile type fastener, where the hook portion is attached to one half of the blower port 13 opening and the pile portion is attached to the other half, as shown in FIG. 7. Blower port fastener means 32 may also be any suitable mechanism for securing the lip 31 to the air blower 73, and preferably comprises means to tighten the lip 31 around the outlet of the air blower 73. This is preferably accomplished by a hook and pile type fastener strap, but could also comprise drawstrings, straps and buckles, etc.

Referring again to FIGS. 1 and 2, it is seen that a number of flexible air conduits 12 extend from the main chamber 11, spaced longitudinally along the device. The air conduits 12 are preferably constructed of the same material as the main chamber 11, although any flexible, air impermeable material can be utilized. Each air conduit 12 is attached to the main wall so that air can flow from the main chamber 11 through the air conduit 12 and out the nozzle end 15 of the air conduit 12. Preferably, air conduit 12 tapers from the point of attachment to the main chamber 11 out to the nozzle end 15. This configuration increases the rate of air flow through the air conduit 11. As shown in FIG. 3, each air conduit 12 is designed to deliver air into an access hole 72 cut into the wall 71. The nozzle ends 15 may comprise an insertion member 16 which is permanently attached to the nozzle end 15. Insertion member 16 is preferably a rigid tube, such as a short length of PVC pipe for example, which allows the flexible air conduit 12 to be snugly fitted into the access hole 72. In a more preferable form, the insertion member 16 is not permanently attached to the nozzle end 15. The nozzle end 15 further comprises conduit fastener means 21 which acts to tighten the nozzle end 15 onto the insertion member 16. This construction is preferable since this allows for insertion members 16 of differing sizes to be used with the device. For example, the nozzle end 15 may be constructed with a diameter of several inches, thus allowing the device to be utilized with any diameter insertion member 16 of smaller size. The conduit fastener means may be any suitable mechanism for tightening the nozzle end 15 onto the insertion member 16, but is preferably a hook and pile type strap, as shown in FIG. 6. Even more preferably, the conduit fastener means is constructed so as to allow sufficient tightening to completely seal off the nozzle end 15 if that particular air conduit 12 is not being used.

The ends 14 of main chamber 11 may be permanently closed, but it is preferable that they be releasably sealed using end fastener means 41. End fastener means 41 may be of any suitable fastener type which allows the ends 14 to be closed to prevent air from escaping yet opened to allow access to the main chamber 11. Preferably, end fastener means 41 is a hook and pile type fastener where the hook portion is attached to the inside of one half of the end 14 and the pile portion is attached to the inside of the other half. To seal the end 14, the hook and pile portions are joined, as shown in FIG. 3. With this construction, the end 14 can be partially opened to allow for insertion of the discharge outlet of a device for introducing deodorants or disinfectants into the main chamber 11, where they will then be blown through the air conduits 12 and into the wall space. It is also possible to incorporate end caps 17 to releasably seal the ends 14, as shown in FIG. 4. End caps 17 are preferably connected to the main chamber 11 by a hook and pile type fastener.

In the most preferred embodiment, ends 14 also incorporate end joining means 42, as shown in FIG. 5. End joining means 42 are suitable fasteners which allow for the end 14 of one main chamber 11 to be openly connected to the end 14 of another main chamber 11. Preferably, end joining means 42 comprise a hook and pile type fastener connected to the outside of each end 14 opening, with the hook portion of the end joining means 42 corresponding to the pile portion of the end fastener means 41, and the pile portion of the end joining means 42 corresponding to the hook portion of the end fastener means 41. In this manner, the end joining means 42 of one end 14 may be connected to the end fastening means 41 of another main chamber 11. This creates a device with double the length, and by continuing the process with other main chambers 11, a drying device of any length can be formed. By sealing off the blower ports 13 of all the main chambers 11 except for one, the enlarged device can be operated off one air blower device 73. For example, with devices consisting of a ten foot long, one foot diameter main chamber 11 with seven twelve inch long air conduits 12, it has been found that a single standard air blower 73 can effectively operate five main chambers 11 joined end to end as described, thus allowing one air blower 73 to dry a 50 foot section of damaged wall. Because the main chambers 11 and air conduits 12 are flexible, the enlarged device can even be utilized around corners or where there are obstructions.

It is understood that those skilled in the art may be aware of obvious substitutions and equivalents for the elements described above, so that the true scope and definition of the invention is to be as set forth in the following claims.

I claim:

1. A wall drying device for use with air blowers comprising a relatively large main chamber and a plural number of air conduits, said main chamber being constructed of a flexible air-impermeable material and having a generally elongated tubular shape and a blower port for connecting said main chamber to an air blower, said air conduits being constructed of a flexible air-impermeable material and comprising elongated, tubular members each having one end attached to said main chamber on the side substantially opposite from said blower port, whereby air may be forced into said main chamber by said air blower and out through said air conduits.

2. The device of claim 1, where each said air conduit has a nozzle end, and where said air conduits taper from the point of attachment to said main chamber to said nozzle end.

3. The device of claim 2, where each said nozzle end further comprises an insertion member, said insertion member adapted to be inserted into an access hole cut into a wall to be dried.

4. The device of claim 3, where said insertion members are removable from said nozzle ends, and said nozzle ends further comprise conduit fastener means to connect said insertion members to said nozzle means.

5. The device of claim 4, where said conduit fastener means are adapted to completely close off said air conduits.

6. The device of claim 5, where said conduit fastener means are comprised of a hook and pile type fastener.

7. The device of claim 1, where said main chamber further comprises two releasably sealable ends having end fastener means.

8. The device of claim 7, where said end fastener means comprises a hook and pile type fastener.

9. The device of claim 7, further comprising end joining means adapted to connect one of said ends of said main chamber to an end of another main chamber.

10. The device of claim 9, where said end joining means comprises a hook and pile type fastener.

* * * * *